United States Patent [19]

Hoyes

[11] Patent Number: 4,569,606

[45] Date of Patent: Feb. 11, 1986

[54] PRINTER APPARATUS

[75] Inventor: Brian G. Hoyes, Pleasanton, Calif.

[73] Assignee: Qume Corporation, San Jose, Calif.

[21] Appl. No.: 599,885

[22] Filed: Apr. 13, 1984

[51] Int. Cl.[4] ..... B41J 1/22

[52] U.S. Cl. ..... 400/144.2; 400/208; 400/175

[58] Field of Search ..... 400/144.2, 144.3, 175, 400/196, 207, 208, 692, 693.1

[56] References Cited

U.S. PATENT DOCUMENTS

| | | | |
|---|---|---|---|
| 3,991,874 | 11/1976 | Klem | 400/207 X |
| 4,330,218 | 5/1982 | Habich et al. | 400/175 X |
| 4,350,452 | 9/1982 | Dials et al. | 400/208 |
| 4,353,655 | 10/1982 | Watanabe et al. | 400/144.2 |
| 4,396,305 | 8/1983 | Shattuck et al. | 400/144.2 X |

FOREIGN PATENT DOCUMENTS

| | | | |
|---|---|---|---|
| 0150583 | 9/1982 | Japan | 400/175 |

OTHER PUBLICATIONS

IBM Technical Disclosure Bulletin, "Automated Print Wheel Removal Mechanism", by Okcuoglu et al., vol. 22, No. 4, 9-79, pp. 1538-1539.

*Primary Examiner*—Edgar S. Burr
*Assistant Examiner*—John A. Weresh
*Attorney, Agent, or Firm*—T. L. Peterson; J. M. May

[57] ABSTRACT

Apparatus to support an inked ribbon cartridge and/or daisywheel motor and assembly. The cartridge has a paper shield integral therewith that is notched to expose the ribbon to the paper, whereby a daisywheel petal carrying a type font may be struck by a print hammer to type a character. The cartridge has a detent to lock the daisywheel motor support in a fixed position. The motor support may be adjusted in position relative to the platen.

2 Claims, 11 Drawing Figures

FIG. 7
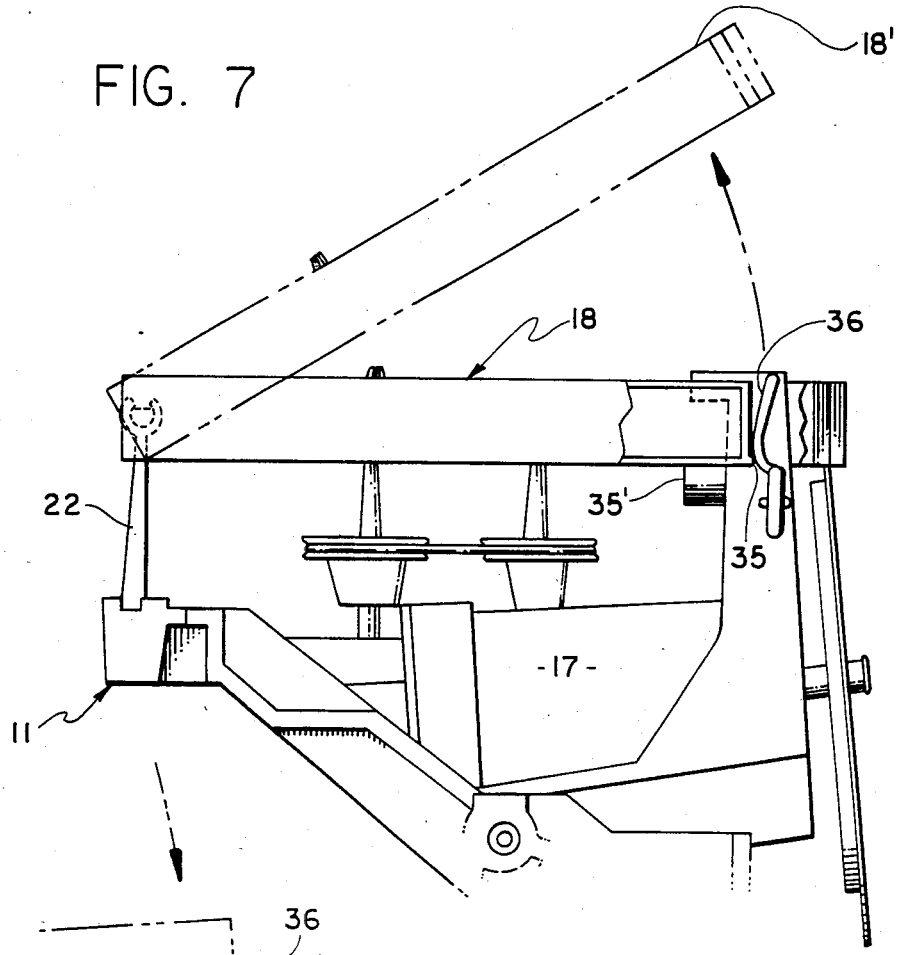
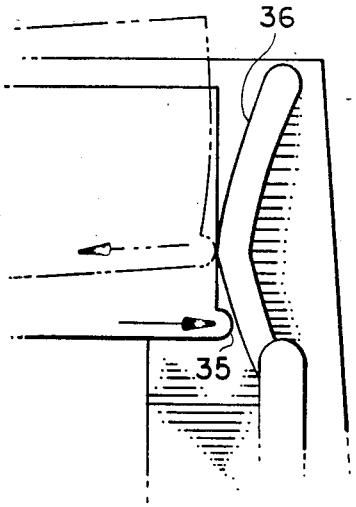
FIG. 8
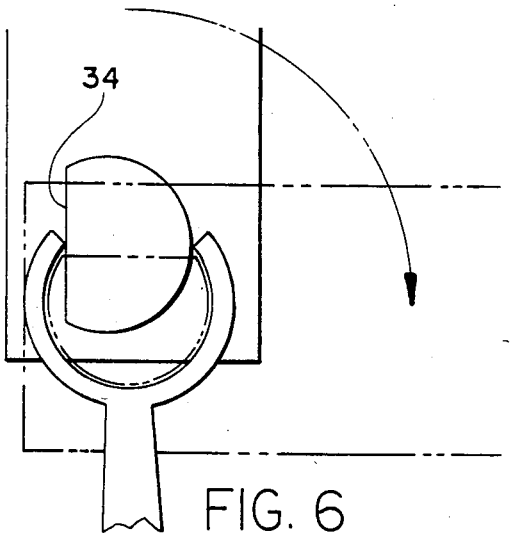
FIG. 6

PRINTER APPARATUS

BACKGROUND OF THE INVENTION

This invention relates to printer apparatus, and more particularly to an inked ribbon cartridge and associated equipment.

PRIOR ART STATEMENT

Prior art ribbon cartridges have a span of unsupported ribbon as is found in British Pat. No. 1,525,935 issued Sept. 27, 1978, and U.S. Pat. No. 4,337,001 issued June 29, 1982.

Paper shields connected with ribbon cartridges are disclosed in U.S. Pat. Nos. 3,643,779 issued Feb. 22, 1972; 3,804,227 issued Apr. 16, 1974; and 3,830,351 issued Aug. 20, 1974.

SUMMARY OF THE INVENTION

In accordance with the present invention, there is provided an inked ribbon cartridge having an integral paper shield.

According to another aspect of the invention, the cartridge is provided with a detent to hold a daisywheel motor in a fixed position.

According to another feature of the invention, the motor is provided with an adjustment.

BRIEF DESCRIPTION OF THE DRAWINGS

In the accompanying drawings which illustrate exemplary embodiments of the present invention:

FIG. 6 is a diagrammatic view of a cartridge hinge;

FIG. 7 is a side elevational view of a printer carriage and ribbon cartridge;

FIG. 8 is an enlarged view of the carriage and cartridge shown in FIG. 7;

DETAILED DESCRIPTION OF THE PREFERRED EMBODIMENT

Figure 1:
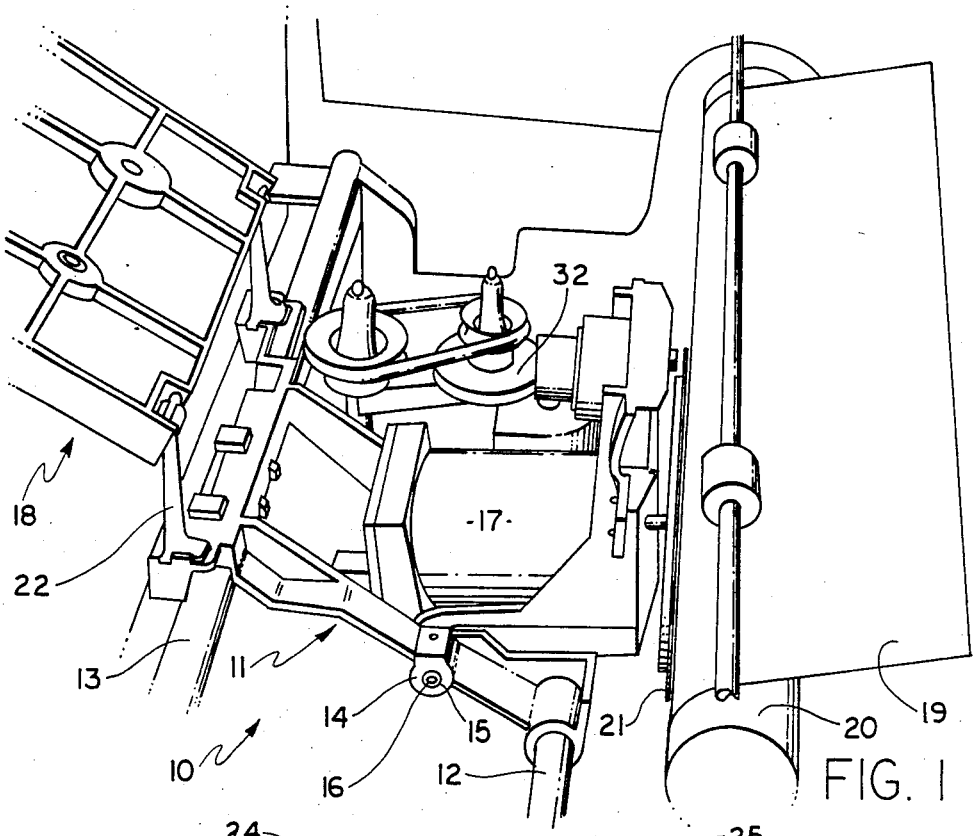
FIG. 1 is a perspective view of a portion of a printer embodying the present invention.

A daisywheel printer as indicated at 10 in FIG. 1 having a carriage 11 slidable along a shaft 12 on a rail 13.

Carriage 11 has a ferrule fixed thereto at 14. Another ferrule 14 is fixed to the opposite side of the carriage (not shown). Ferrules 14 carry bearings 15 with shafts 16 journaled therein.

A motor 17 for a daisywheel 21 is mounted or fixed to shaft 16. When a ribbon cartridge 18 is rotated to the position shown in FIG. 1, motor 17 may be rotated upwardly and rearwardly from the position shown adjacent paper 19 on a platen 20.

Figure 2:
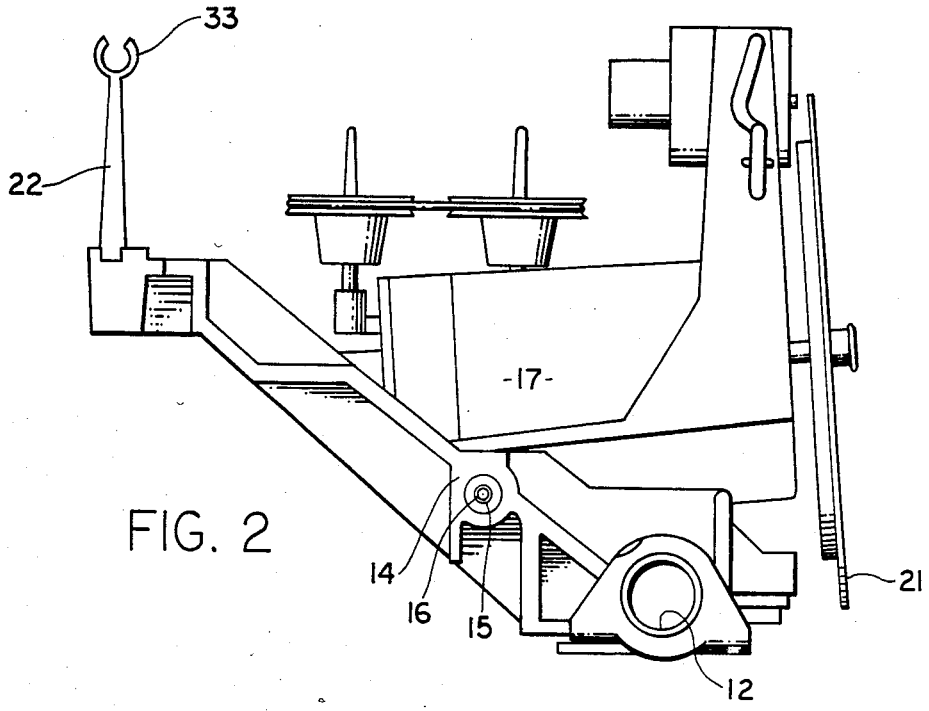
FIGS. 2 and 3 are side elevational views showing a printwheel motor in lower and upper positions, respectively.

Motor 17 shown in FIG. 1 is shown in the same position in FIG. 2.

Figure 3:
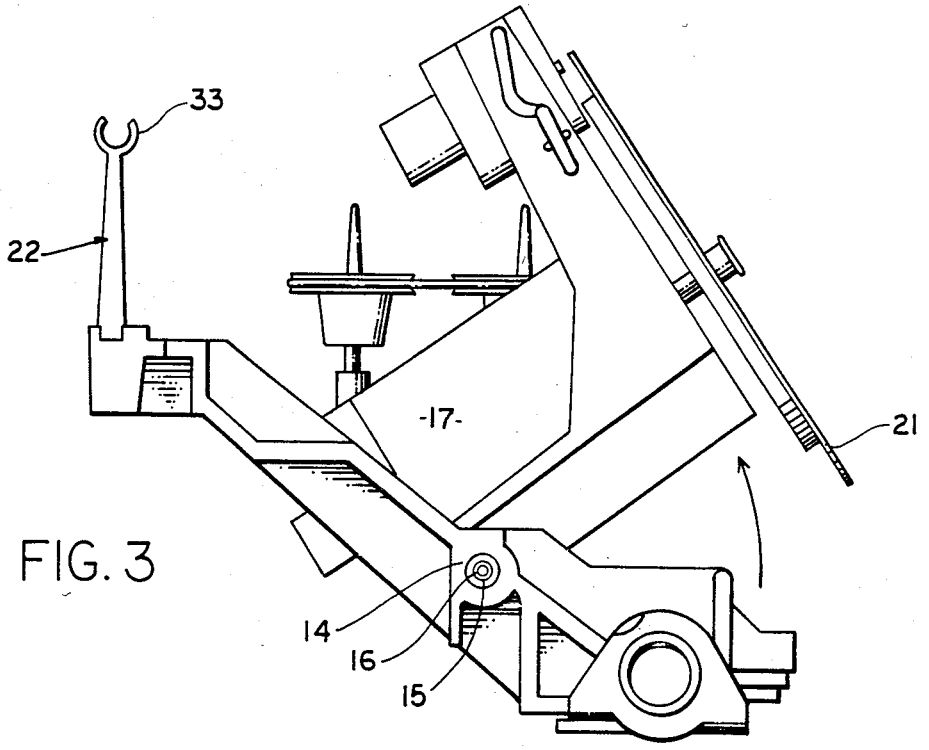
Figure 11:
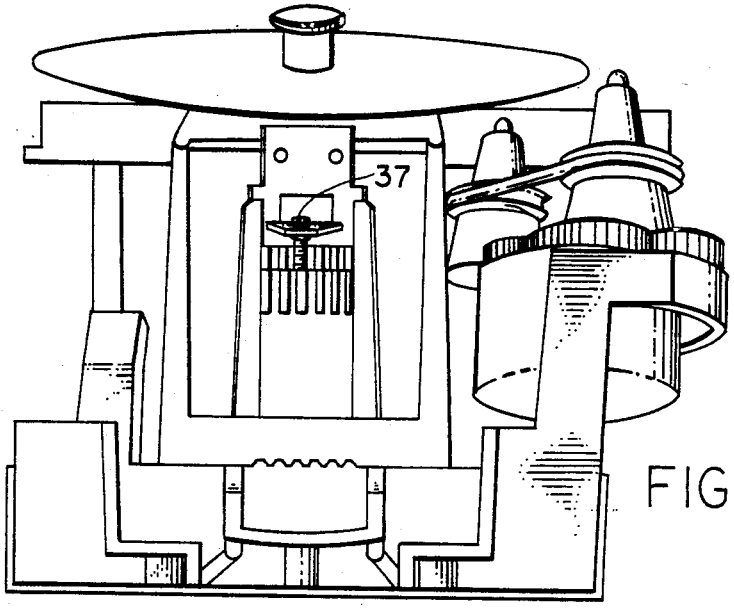
FIG. 11 is a front elevational view of a daisywheel motor in the upper position as shown in FIG. 3.

In FIG. 3, motor 17 has been rotated upwardly and rearwardly away from the platen in a counterclockwise direction.

Printwheel 21 is also shown in both FIGS. 2 and 3.

Ribbon cartridge 18 is conventional in some respects and new in others. Ribbon cartridge 18 has a ribbon take-up spool 18'' and a dispenser spool 18'''. Cartridge 18 may be removed from carriage 11. When removed, cartridge 18 has a top plan view as seen in FIG. 4.

As shown in FIGS. 1 and 7, cartridge 18 is hinged from upwardly extending projections 22 and 23 at the rear of carriage 11.

Figure 4:
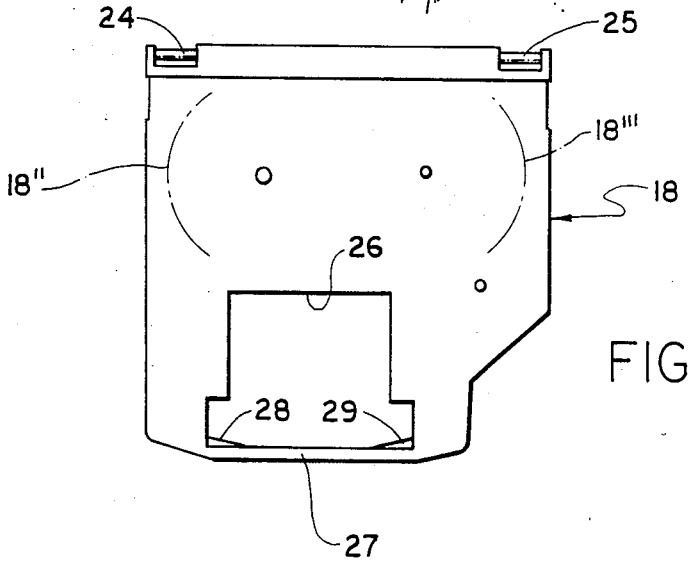
FIG. 4 is a top plan view of a ribbon cartridge of the present invention.

As shown in FIG. 4, cartridge 18 is hinged at shafts 24 and 25.

Figure 5:
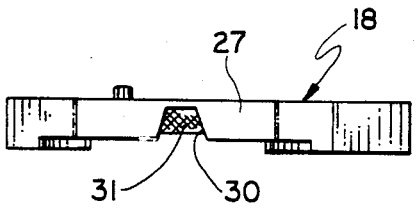
FIG. 5 is a front elevational view of the cartridge.

Cartridge 18 has an opening 26 which is completely closed by a bridge 27. The ribbon extends across the rear of bridge 27 between it and guides 28 and 29. The bridge has a cutout 30 that exposes ribbon 31. The fonts on the printwheel 21 strike ribbon 31 from the side opposite that shown in FIG. 5 and make a printed letter on paper 19. The remainder or the interior of cartridge 18 may be entirely conventional.

The drive for the ribbon 31 is provided by a motor 32 shown in FIG. 1. The ribbon drive is entirely conventional.

As shown in FIGS. 2 and 3, the upper end of each of the projections 22 and 23 has a U-shaped construction with which a hinge is made with shafts 24 and 25. (FIG. 4) This is shown in FIG. 6. Note that shafts 24 and 25 have a flat 34 which makes it possible to slide the cartridge to the position shown in FIG. 1. Cartridge 18 may be moved from the solid line position shown in FIG. 7 to the dotted line position 18'. When it is moved from the dotted line position of the solid line position in FIG. 7, a portion of the apparatus carrying motor 17 has a projection 36 below which detent 35 snaps (see FIG. 8).

Figure 9:
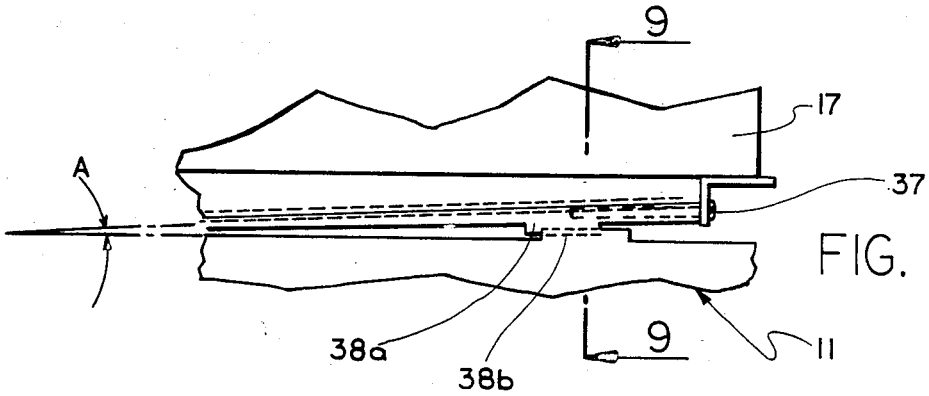
FIG. 9 is an enlarged elevational view of a daisywheel motor adjustment.
Figure 10:
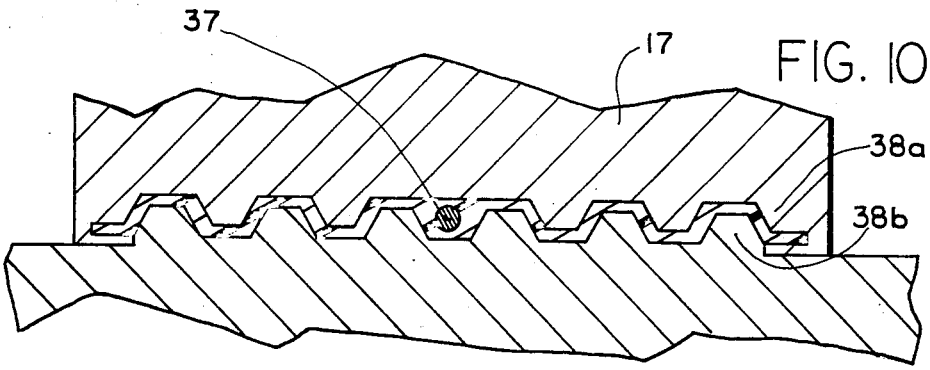
FIG. 10 is a transverse sectional view taken on the line 9—9 shown in FIG. 8.

Thus, cartridge 18 performs a dual function. It not only holds itself in place by the action of the detent 35 below projection 36, but it also holds motor 17 in a guided position against an adjustable lower support **38*b* on the carriage 11 as shown in FIGS. 9 and 10. An adjustment screw 37 adjusts the position of a moving tongue in groove arrangement 38*a* which adjusts the angle A the motor 17 makes with carriage 11**.

In the solid line position shown in FIG. 7, the front of ribbon cartridge 18 is supported motor assembly 17 by front support 35'.

What is claimed is:

1. In a printer or the like, the combination comprising: a base; a platen; a carriage movable along said platen; a daisywheel motor assembly including a daisywheel and a motor hinged on said carriage to move said daisywheel in an arc downwardly and forwardly to and upwardly and rearwardly from said platen; and a ribbon cartridge hinged to a pair of upwardly extending projections at the rear of said carriage, said carriage having a lower support for said daisywheel assembly for restraining said daisywheel assembly from further downward movement when said carriage is in contact with said lower support, said ribbon cartridge being pivotal between a raised position in which said daisywheel motor assembly is free to pivot and a lower position in which said daisywheel motor assembly is restrained from pivoting, said ribbon cartridge having a detent which, in said lower position, is forwardly facing, said daisywheel motor assembly having a front support for said ribbon cartridge and a rearwardly facing projection thereabove, said detent snapping down below said projection to positively hold both said ribbon cartridge and said daisywheel assembly in fixed positions.

2. The invention as defined in claim 1, wherein said lower support is adjustable in height.

* * * * *